US007691011B1

(12) United States Patent
Roman

(10) Patent No.: US 7,691,011 B1
(45) Date of Patent: Apr. 6, 2010

(54) DURABLE GOLF TEE

(76) Inventor: Gregory S. Roman, 1501 Muirfield Dr., Greenville, NC (US) 27858

( * ) Notice: Subject to any disclaimer, the term of this patent is extended or adjusted under 35 U.S.C. 154(b) by 123 days.

(21) Appl. No.: 11/839,886

(22) Filed: Aug. 16, 2007

(51) Int. Cl.
*A63B 57/00* (2006.01)

(52) U.S. Cl. ..... 473/387

(58) Field of Classification Search ..... 473/387–403; D21/717, 718
See application file for complete search history.

(56) References Cited

U.S. PATENT DOCUMENTS

| | | | | |
|---|---|---|---|---|
| 1,627,012 | A * | 5/1927 | Copeland | 473/394 |
| 1,670,123 | A * | 5/1928 | Ranseen | 473/396 |
| 1,681,391 | A * | 8/1928 | Bratt | 473/400 |
| 1,699,934 | A * | 1/1929 | Warner | 473/401 |
| 3,559,998 | A * | 2/1971 | Kelly | 473/396 |
| 4,783,077 | A * | 11/1988 | Lemon | 473/402 |
| 4,787,637 | A * | 11/1988 | Lima et al. | 473/396 |
| 4,951,945 | A * | 8/1990 | Gamble | 473/400 |
| 5,571,055 | A * | 11/1996 | Lewis et al. | 473/398 |
| 5,720,677 | A * | 2/1998 | Rudduck | 473/387 |
| 5,820,490 | A * | 10/1998 | Hronas et al. | 473/391 |
| 6,224,500 | B1 * | 5/2001 | Mizohata | 473/396 |
| 6,224,501 | B1 * | 5/2001 | Rudduck et al. | 473/401 |
| 2002/0022538 | A1 * | 2/2002 | Choi | 473/396 |
| 2005/0026726 | A1 * | 2/2005 | Barouh | 473/398 |
| 2008/0070724 | A1 * | 3/2008 | Elder | 473/396 |

* cited by examiner

*Primary Examiner*—Steven Wong
(74) *Attorney, Agent, or Firm*—Ishman Law Firm P.C.

(57) ABSTRACT

A durable golf tee having one piece body formed of a high modulus thermoplastic, preferably ultra high molecular weigh polyethylene (UHMWPE). The head of the tee includes a grooved area providing an area for material deformation at club head impact such that the area supporting the golf ball retains shape and structural integrity, and barbs are provided on the tee shank for resisting ground separation upon impact.

5 Claims, 6 Drawing Sheets

DURABLE GOLF TEE

FIELD OF THE INVENTION

The present invention relates to golf tees and, in particular, a golf tee of improved durability.

BACKGROUND OF THE INVENTION

A golf tee supports a golf ball in such a manner that the golf club may strike the ball without inference from the ground. Numerous golf tees of various forms and functions have been proposed. The most common golf tee is the wooden or plastic tee, which has a cup shaped top portion supporting the golf ball and a bottom portion, which tapers to a point, which is used to insert the tee into the ground. The wooden tee is relatively easily broken. The failure mode for plastic tees is either breakage or shape deformation. A plastic tee made of rigid material tends to have poor impact strength. A plastic tee made of flexible material tends to have material deformation in the area supporting the ball from repeated impacts from the golf club.

Most common golf tees are constructed of materials, which do not possess adequate impact strength to withstand the force delivered by the golf club. Use of a golf tee made of material harder than the striking face of the golf club would result in damage to the golf club. Traditional tees are constructed of materials, which do not yield upon impact of the golf club. Other materials, which would withstand the impact of the club head are hard enough to damage the club face or are exotic composites, which would not be cost effective for the manufacture of a golf tee.

At impact, the golf tee is frequently dislodged from the ground and propelled some distance. This frequently results in loss of the tee. The present invention addresses these and other problems.

SUMMARY OF THE INVENTION

The present invention is a durable one piece golf tee with features to preserve the structural integrity and form of the area supporting the ball and throughout the length of the tee. There are also features to better retain the tee in the ground after impact occurs. The tee is made of a polymeric material, preferably ultra high molecular weight polyethylene (UHMWPE), or material with similar mechanical properties. An annular grooved area separates the area, which supports the golf ball, and an area outside the groove, which deflects and absorbs the impact from the golf club. This prevents material deformation to the cup shaped ball support upon impact of the golf club.

The top of the tee is designed such that impact of the golf club will occur at an area on the tee prior to reaching the area supporting the golf ball. The area supporting the golf ball requires shape retention since it is relatively smaller than the sphere it supports.

Numerous golf tees have been made of thermoplastic compounds in various shapes. The compounds used thus far provide adequate rigidity, but are brittle to the point where the tee breaks upon impact. UHMWPE provides the best mechanical properties to employ in golf tee design. A golf tee of the invention provides a resistance to breakage, an easy insertion into the ground, a low coefficient of friction with the ball, and does not damage the club face. The tee conforms to the USGA rules of golf and is economical to manufacture.

The shape of the top of the tee provides an area for material deformation at club head impact such that the area supporting the golf ball retains shape and structural integrity. The tee is a one piece construction comprised of ultra high molecular weight polyethylene (UHMWPE) or a material with similar mechanical properties. The mechanical properties of UHMWPE provide low coefficient of friction, high abrasion resistance, high impact strength and moderate hardness. The shank of the tee is downwardly tapered which provides enough rigidity through the length of the tee to enable insertion into the teeing ground.

Accordingly, it is an object of the invention to provide a new and improved golf tee, which can be manufactured inexpensively.

Another object of the invention is to provide a new and improved golf tee made of a material possessing very low coefficient of friction, which presents less interference between the tee and golf ball at impact.

Another object of the invention is to provide a geometric feature near the bottom tip of the tee to better retain the tee in the ground after impact occurs.

BRIEF DESCRIPTION OF THE DRAWINGS

The above and other features and advantages of the invention will become apparent upon reading the following description taken in conjunction with the accompanying drawings in which.

DETAILED DESCRIPTION OF THE PREFERRED EMBODIMENTS

Figure 1:
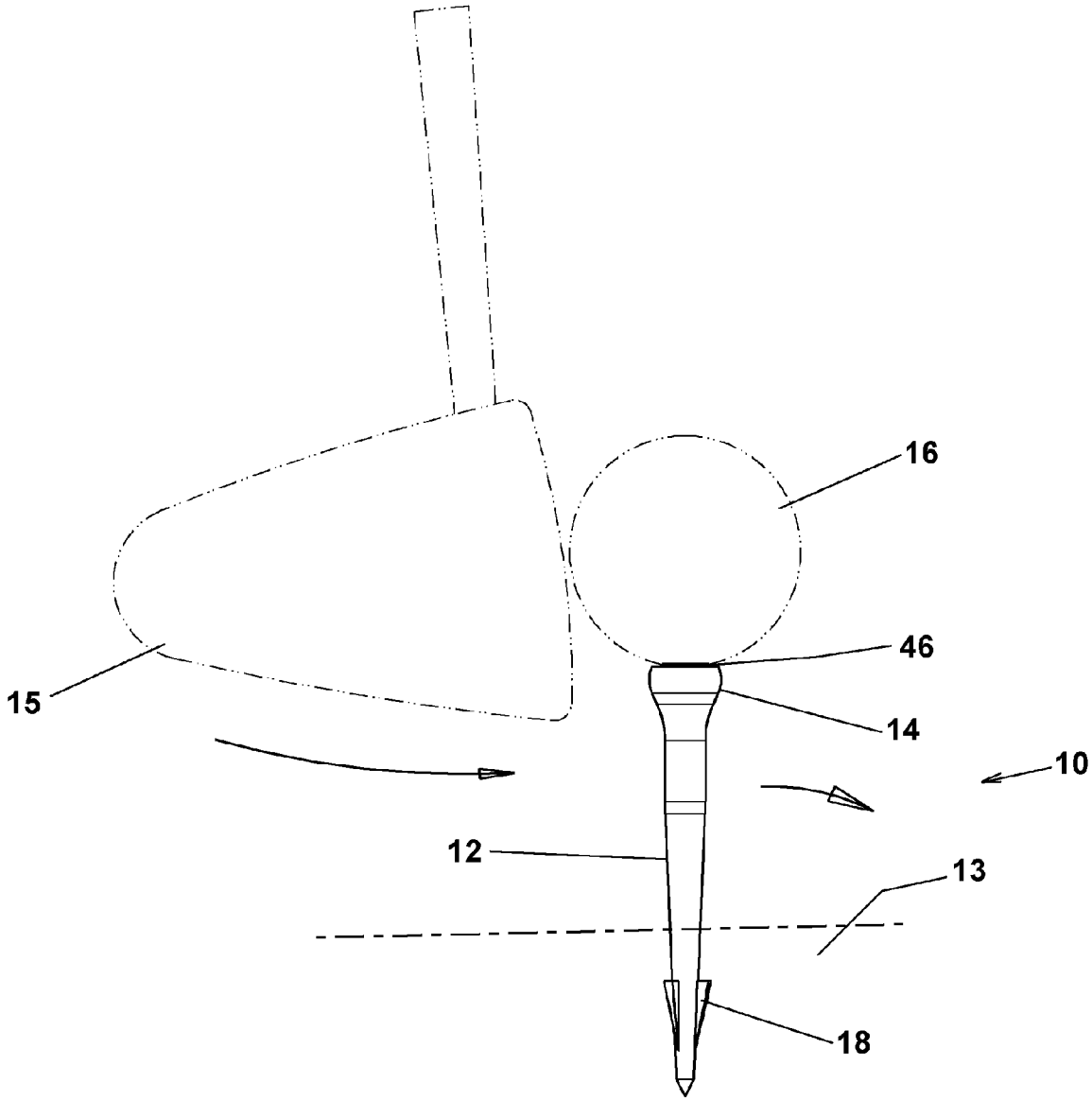
FIG. 1 is a side view of a durable golf tee according to an embodiment of the invention supporting a golf ball at a tee position.
Figure 2:
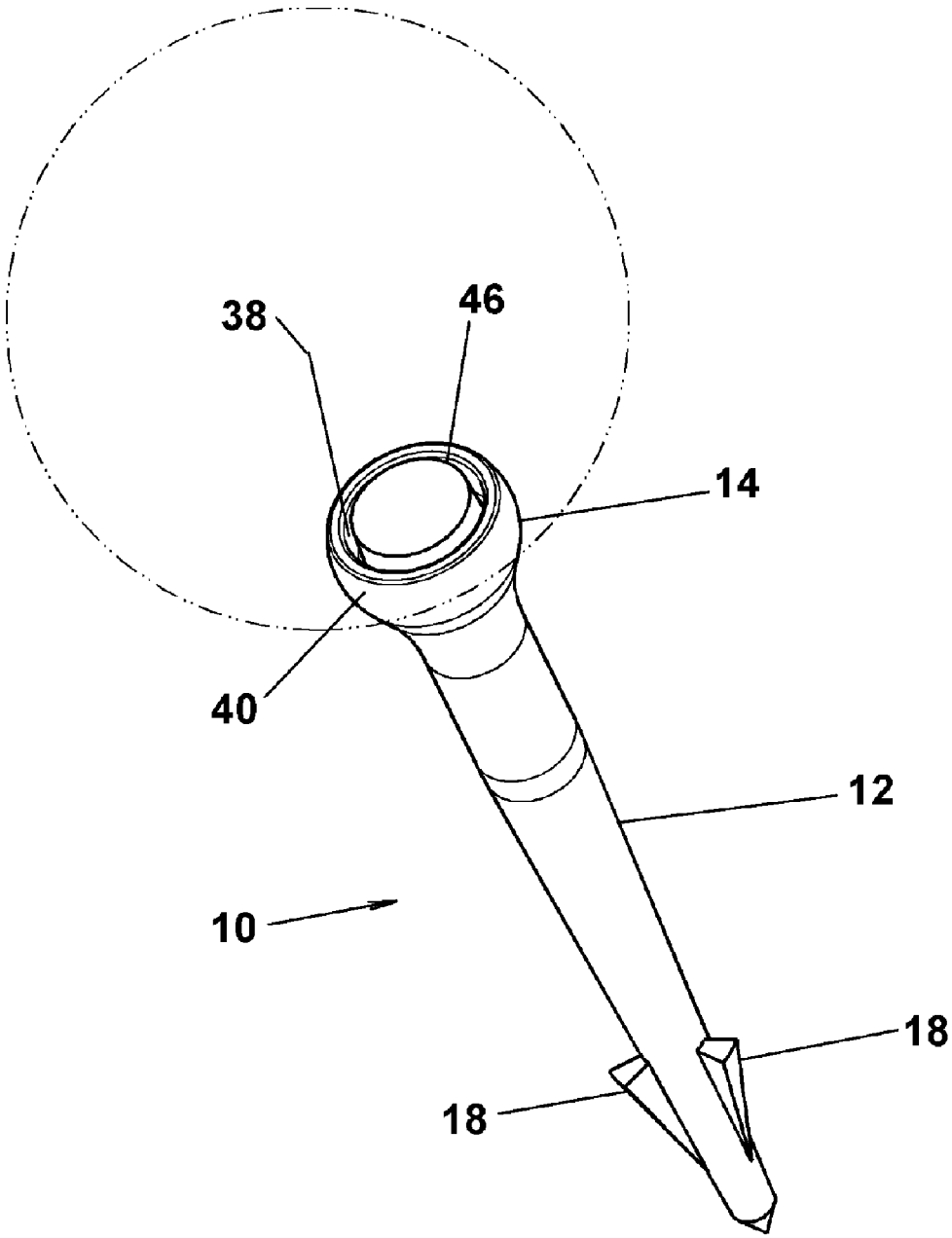
FIG. 2 is a perspective view of a durable golf tee of FIG. 1.
Figure 6:
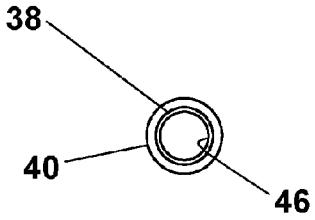
FIG. 6 is a top view of the golf tee of FIG. 1.
Figure 5:
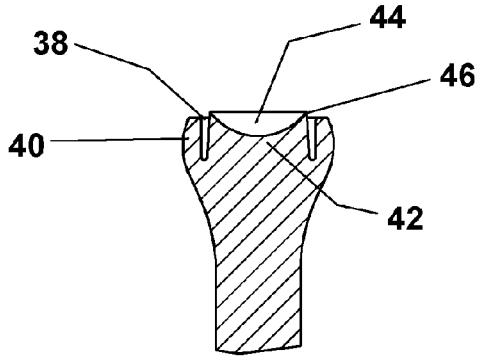
FIG. 5 is an enlarged fragmentary cross sectional view of the head section of the golf tee of FIG. 1.
Figure 3:
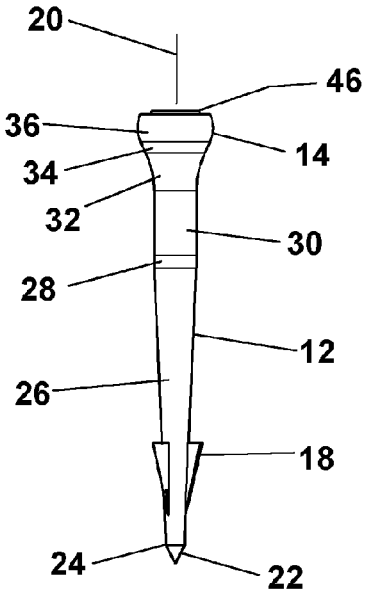
FIG. 3 is a side elevational view of the golf tee of FIG. 1.
Figure 4:
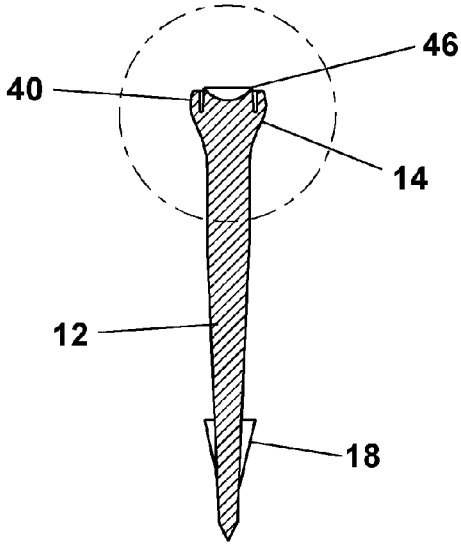
FIG. 4 is a vertical cross sectional view of the golf tee of FIG. 1.
Figure 7:
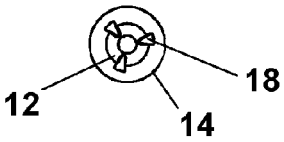
FIG. 7 is a bottom view of the golf tee of FIG. 1.
Figure 8:
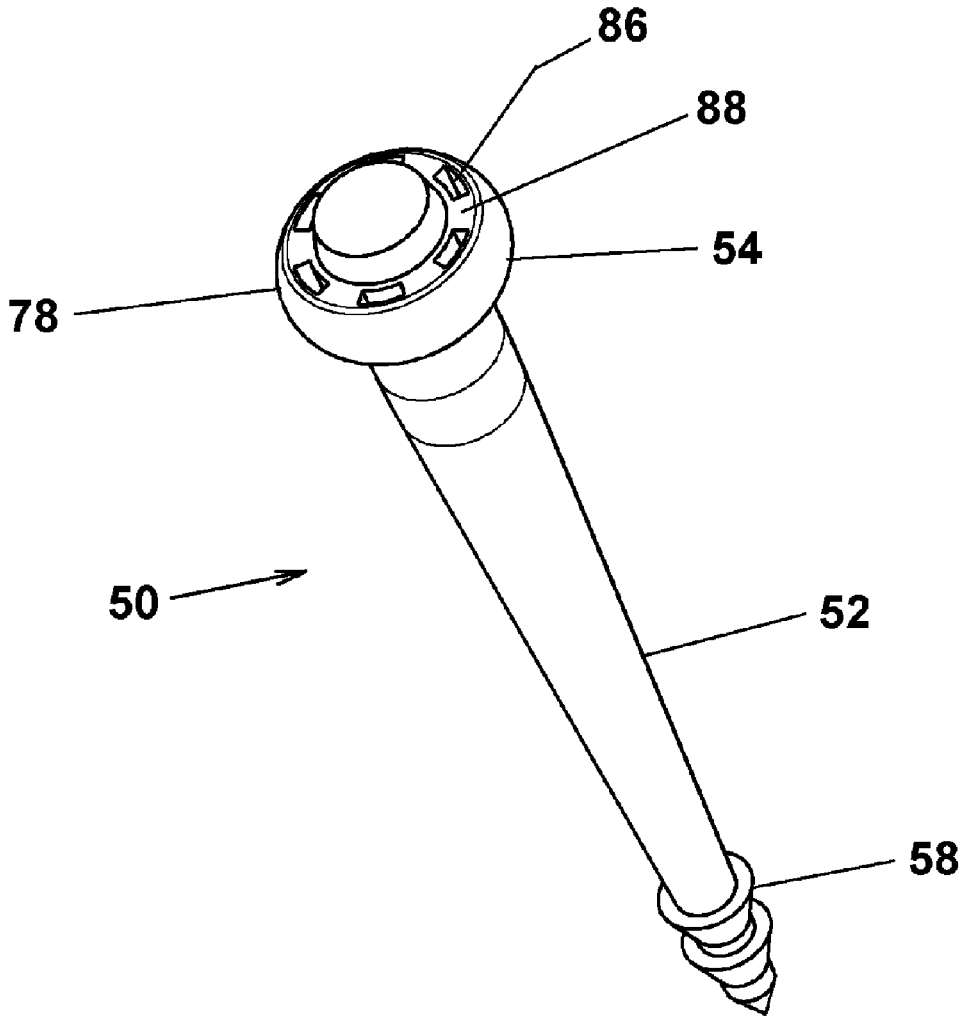
FIG. 8 is a perspective view of a durable golf tee in accordance with another embodiment of the invention.
Figure 12:
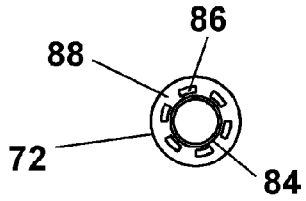
FIG. 12 is a top view of the golf tee of FIG. 8.
Figure 11:
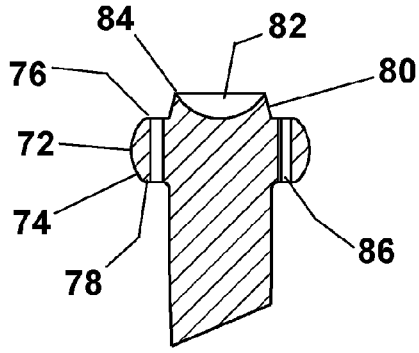
FIG. 11 is an enlarged fragmentary cross sectional view of the head section of the golf tee of FIG. 8.
Figure 9:
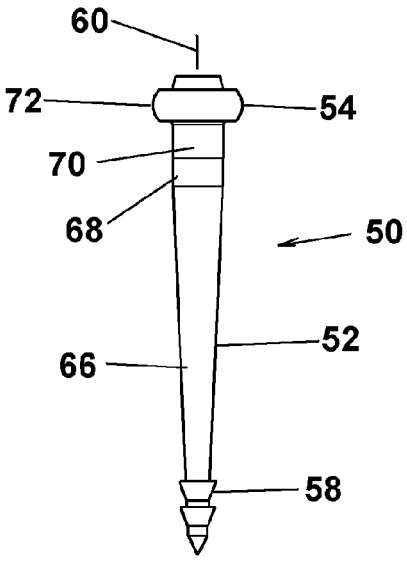
FIG. 9 is a side view of the golf tee of FIG. 8.
Figure 10:
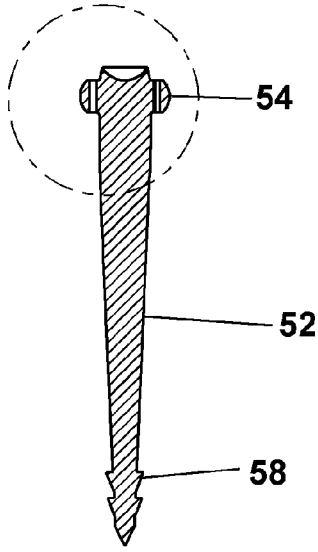
FIG. 10 is a vertical cross sectional view of the golf tee of FIG. 8.
Figure 13:
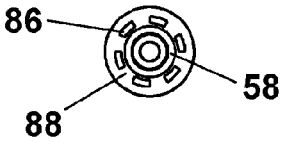
FIG. 13 is a bottom view of the golf tee of FIG. 8.

Referring to FIGS. 1 through 3, there is shown one embodiment of a durable golf tee 10 according to the invention with an improved usable life span when compared to golf tees currently in use. The materials and configuration of the tee eliminates damage from club face impact, resists abrasion, lowers the coefficient of friction for increased ball speed at impact, and yields at impact of the club head instead of breaking. The tee can be produced by cost effective manufacture including machining and molding.

The golf tee 10 comprises a unitary body of impact resistant plastic. A suitable material is a high modulus thermoplastic with ultra high molecular weight polyethylene (UHMWPE), also known as high modulus polyethylene (HMPE) or high performance polyethylene (HPPE), being a preferred material. The golf tee 10 includes a lower shank 12 for insertion into the ground 13 at a tee or driving location and a head 14 for supporting a golf ball 16 impacted by the face of a golf club 15. The shank 12 includes three axially and radially extending barbs 18 providing resistance to extraction of the tee from the ground upon club impact.

Referring additionally to FIGS. 3 through 7, the shank 12, with the exception of the barbs 18, and the head 14 are surfaces of revolution about a vertical axis 20. The shank 12 includes a frustoconical sharp lower tip 22 merging at transition 24 to a shallow angle frustoconical center section 26 merging at transition 28 with a cylindrical upper section 30. The barbs 18 are circumferentially spaced and radially outwardly projecting. The barbs 18 have a generally triangular shape with an apex adjacent the tip and flat annular transverse bases.

The head 14 includes an outer concave surface 32 merging at transition 34 with the upper section 30 of the shank and merging with a convex surface 36 curving upwardly and inwardly toward the axis 20. The head 14 includes an upwardly opening continuous circumferential grooved area in the top surface in the form of an annular slot 38 establishing an outwardly deflectable annular lip or sleeve 40 that deflects about a connecting web to limit force transmission to a cup shaped cylindrical ball support 42 having a concave depression 44 in the top surface forming an annular rim 46 that supports the golf ball. The annular sleeve being below the cylindrical ball support.

In play, when the golf club 15 impacts the golf ball 16, the ball is propelled with minimal resistance due to the limited contact area at the rim 46 and the low coefficient of friction of the tee material. If the club thereafter impacts the tee 10, the force is absorbed at the sleeve 40 by deflection before contacting the support 42. Under excessive loads, the force is highly attenuated and any impact is within the elastic limits of the material, thus avoiding any damage to the support notwithstanding deformation on the exterior surface. Further any tendency for the tee to separate from the ground at impact is overcome by the drag resistance provided by the barbs 18, which upon impact effect a tilt of the axis and are thus placed in a shearing relationship with the surrounding ground material. Accordingly, the tee remains at the tee position for retrieval, without structural damage, and ready for reuse.

Another embodiment of the invention is shown in FIGS. 8-13 wherein a durable golf tee 50 comprises a unitary body of impact resistant plastic including a lower shank 52 for insertion into the ground and a head 54 for supporting a golf ball. The shank 52 includes three axially spaced enlarged annular barbs 58 providing resistance to extraction of the tee from the ground upon club impact. The shank 52 and the head 54 are surfaces of revolution about a vertical axis 60. The shank 52 includes a frustoconical sharp lower tip merging to a shallow angle frustoconical center section 66 merging at transition 68 with a cylindrical upper section 70. The side surfaces of the barbs 58 flare conically outwardly from a tip at the lower end and a transverse flat annular base at an upper end.

The head 54 includes an enlarged annular sleeve 72 having a convex outer surface 74 and axially spaced annular upper and lower surfaces 76, 78, respectively. The upper surface 76 merges inwardly with an upwardly extending frustoconical support 80. A concave depression 82 is formed in the upper surface of the support establishing and annular rim 84 for contacting and support the golf ball. The circumferential grooved area is provided by a plurality of annular aperture sectors 86 mutually circumferentially spaced by radial webs 88 and establishing the deflectable annular sleeve 72 outwardly thereof. Upon impact, the sleeve locally deflects absorbing the club impact and limits force transmission to the support thus avoiding any damage to the support and rim notwithstanding deformation on the exterior surface. Further any tendency for the tee to separate from the ground at impact is overcome by the drag resistance provided by the barbs 58, which tilt upon impact and are placed in a shearing relationship with the surrounding ground material. Accordingly, the tee remains at the tee position for retrieval, without structural damage, and reuse.

Figure 15:
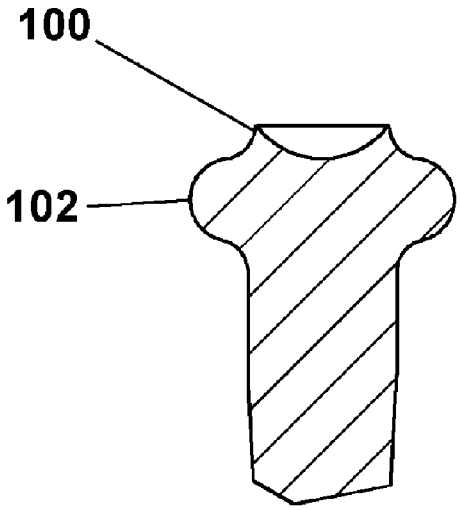
FIG. 15 is a partial cross sectional view of the head of a durable golf tee in accordance with another embodiment of the invention.
Figure 14:
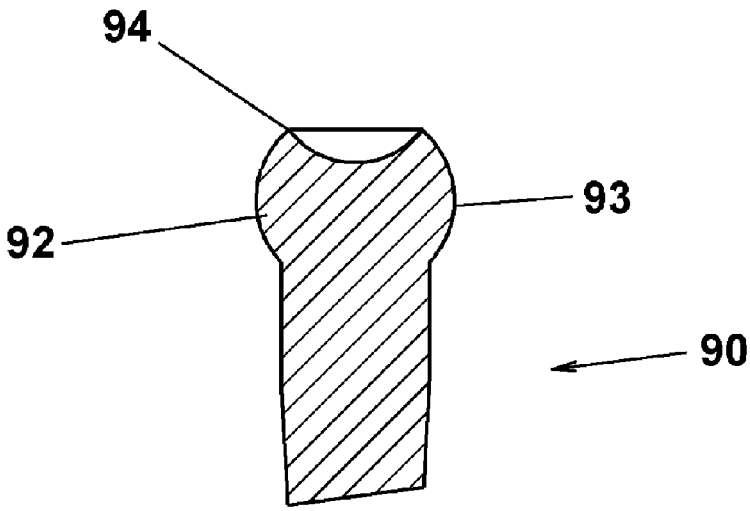
FIG. 14 is a partial cross sectional view of the head of a durable golf tee in accordance with another embodiment of the invention.

Because of the properties of the ultra high molecular weight polyethylene (UHMWPE), many of the durability aspects of the invention may be provided without the stress relieving grooving. FIG. 14 shows a tee 90 having an enlarged annual head 92 with an outer convex surface 93 provided with an axial depression establishing a support ring 94 for the golf ball. The convex surface 92 cause the club to glance off the head and forwardly and downwardly pivot the tee thereby reducing dislodging. Further as shown in FIG. 15 the ball support 100 may project slightly above the enlarged annular convex sleeve 102 with the head contour effecting downward pivoting and any barbs on the shank resisting extraction.

It will be appreciated that the invention has fulfilled the stated objectives providing a durable golf tee that resists impact deformation and loss by travel from the tee position.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the spirit and scope of the present invention. The disclosures and description herein are intended to be illustrative and are not in any sense limiting of the invention, which is defined solely in accordance with the following claim.

What is claimed is:

1. A durable golf tee comprising: a unitary body of a high modulus thermoplastic having a downwardly tapering shank for insertion into the ground at a tee location and an enlarged head for supporting a golf ball integral with said shank about a vertical axis, said shank including a plurality of barbed sections having transverse ground engaging surfaces effective upon impact tilting of said axis to present shearing surfaces with the ground resisting extraction of said body from the tee location; a continuous circumferential upwardly opening annular groove in said head establishing an outer annular sleeve section attached to a cylindrical inner portion of said head and axially therebelow, a depression formed in a top surface of said inner portion of said head having an outer rim for directly contacting and supporting the golf ball, said sleeve section deforming upon impact by a golf club with said groove limiting force transmission to said inner portion of said head and deformation of said outer rim.

2. The durable golf tee as recited in claim 1 wherein said body is formed of ultra high molecular weight polyethylene.

3. The durable golf tee as recited in claim 1 wherein said barbed sections extend axially and are radially spaced.

4. The durable golf tee as recited in claim 1 wherein said barbed sections have a triangular radial cross section.

5. The durable golf tee as recited in claim 1 wherein said barbed sections are annular and axially spaced.

* * * * *